United States Patent [19]

Economopoulos

[11] 4,204,892

[45] May 27, 1980

[54] HEAT-TREATING TUBULAR STEEL SECTIONS

[75] Inventor: Marios Economopoulos, Liege, Belgium

[73] Assignee: Centre de Recherches Metallurgiques-Centrum voor Research in de Metallurgie, Brussels, Belgium

[21] Appl. No.: 950,985

[22] Filed: Oct. 13, 1978

[30] Foreign Application Priority Data

Oct. 14, 1977 [BE] Belgium ..... 859780
Apr. 25, 1978 [BE] Belgium ..... 866366

[51] Int. Cl.[2] ..... C21D 9/08

[52] U.S. Cl. ..... 148/145; 148/12.4; 148/39; 148/150; 148/152; 148/153

[58] Field of Search ..... 148/143, 12.4, 145, 148/150, 152, 153, 39

[56] References Cited

U.S. PATENT DOCUMENTS 3,926,689 12/1975 Respen et al. ..... 148/12.4

*Primary Examiner*—R. Dean
*Attorney, Agent, or Firm*—Holman & Stern

[57] ABSTRACT

A tubular steel section at a temperature, above $Ac_1$, at which the steel contains at most 15% ferrite is subjected to martensitic and/or bainitic quenching followed by still air cooling. The effects of quenching are limited to a surface layer, internal and/or external, of the section. At the end of the quenching step the part of the section remote from the quenched surface layer or layers is at a temperature above 675° C. which permits self-tempering of the quenched surface layer or layers at a temperature above 450° C. and ensures transformation of residual austenite to a martensite-free structure.

14 Claims, 3 Drawing Figures

HEAT-TREATING TUBULAR STEEL SECTIONS

The present invention relates to improvements in processes for treating tubular steel sections, such as for example tubes of various shapes or cross-sections obtained by rolling, extrusion, drawing, or any other means. These improvements are carried out on sections that are basically at a temperature corresponding to an at least partially austenitic state, either at the outlet of the last hot-rolling stand or after a suitable reheating treatment, and whatever the type of reheating or the state of the section before the reheating treatment.

For the sake of simplicity, in the following description the expression "tube" used hereinafter shall denote any type of tubular section regardless of its shape or method of manufacture.

It is known that the main qualities that the users look for in tubes are, inter alia, an elastic limit (yield strength) as high as possible (for example about 50 kg/mm$^2$ (500 MPa)) as well as weldability and a fatigue strength and ductility that are also as high as possible.

It is also known that in order to improve the weldability and ductility of a steel, the content of carbon and manganese must be reduced, which however at the same time reduces its tensile strength. In order to obviate this disadvantage the steel may be subjected to a suitable cooling treatment, preferably applied directly at the outlet of the rolling mill, which will to some extent increase the elastic limit of a bar or ingot.

In general, in present-day rolling mills the bars and tubes are cooled by convection or radiation, and since the rate of cooling depends virtually only on the diameter of the section in question, the result is that in order to alter the elastic limit of a bar or tube of a specific diameter it is necessary to involve processes other than a pure and simple cooling.

Of these processes, there may in particular be mentioned the addition of dispersoid elements (Nb, V) which refine the grain size and cause hardening of the ferrite by precipitation. This process is indeed effective but has the disadvantage that its cost increases the higher the elastic limit it is desired to obtain.

What is desired is a process enabling the aforementioned disadvantage to be avoided without the amounts of carbon and manganese in the steel increasing to an unacceptable level as regards weldability.

The present invention provides a process in which the tubular steel section, which is at a temperature greater than or equal to $Ac_3$ or at a temperature between $Ac_3$ and a temperature (between $Ac_3$ and $Ac_1$) corresponding to at most 15% ferrite in the steel, is subjected to an operation of martensitic and/or bainitic quenching, by means of a cooling agent, the conditions of intense cooling to a temperature below the temperature $M_s$ of martensite formation are controlled in such a manner that the effects of quenching are limited to a surface layer (internal and/or external) of the section and that, at the end of the quenching step, the part of the section furthest from the quenched zone is at a temperature above 675° C. which permits self-tempering of the surface layer at a temperature above 450° C. and ensures transformation of residual austenite to a martensite—free structure, and, after this tempering step, the section is subjected to still air cooling.

The process may, as already mentioned, be carried out directly at the outlet of the last hot-rolling stand or after reheating, and it may be carried out from the interior of the tube, in which case the tube then has a layer of martensite on its inner surface. It should therefore be understood that the residual austenite in the tube exists, depending on the case in question, either in the region underlying the quenched surface or surrounding it, or between the two quenched surfaces. Moreover, as regards the diagrams given hereinafter, the word "core" denotes that part of the tube farthest from the quenched surface, in the case of a single quenched surface, or the semi-thickness, in the case where both surfaces are quenched.

According to a first embodiment of the process of the application, the quenching phase is carried out at an intensity and for a period of time such that after the temperatures are equalised by self-tempering in the tube, at a so-called "tempering temperature," transformation of the residual austenite into ferrite plus carbides takes place, the duration of the quenching phase preferably being between 5 and 15 seconds. Particularly useful results have been observed according to this method of operation if the tubes to which this embodiment has been applied have the following composition, in particular for wall thicknesses exceeding 6 mm:

| |
|---|
| $0.10\% \leqq C \leqq 0.15\%$ |
| $1.0\% \leqq Mn \leqq 1.5\%$ |
| $0.2\% \leqq Si \leqq 0.4\%$ |
| $Cu \leqq 0.2\%$ |
| $0.5\% \leqq Ni \leqq 1\%$ |
| $Cr \leqq 0.8\%$ |
| $0.1\% \leqq Mo \leqq 0.4\%$ |

the remainder consisting of iron together with its usual impurities.

By means of the above embodiment, the tubes having the afore-mentioned percentage composition and for which the annealing temperature is between 500° C. and 700° C. have, after treatment, a tensile strength of between 500 and 900 MPa (the values are given by way of example and are not limiting).

According to a second embodiment of the above process, the quenching phase is carried out in the martensitic range at an intensity and for a period of time such that, after the temperatures in the tube are equalised by self-tempering, at a so-called tempering temperature, the residual austenite is basically transformed into bainite, preferably lower bainite, which enables a better "ductility toughness - strength" combination to be obtained compared with the first embodiment. It may be noted that in this embodiment the duration of the quenching phase is shorter, so as to enable the austenite-bainite transformation to occur rapidly after the temperatures have equalised.

The invention will be described further, by way of example only, with reference to the accompanying drawings, in which.

Figure 1:
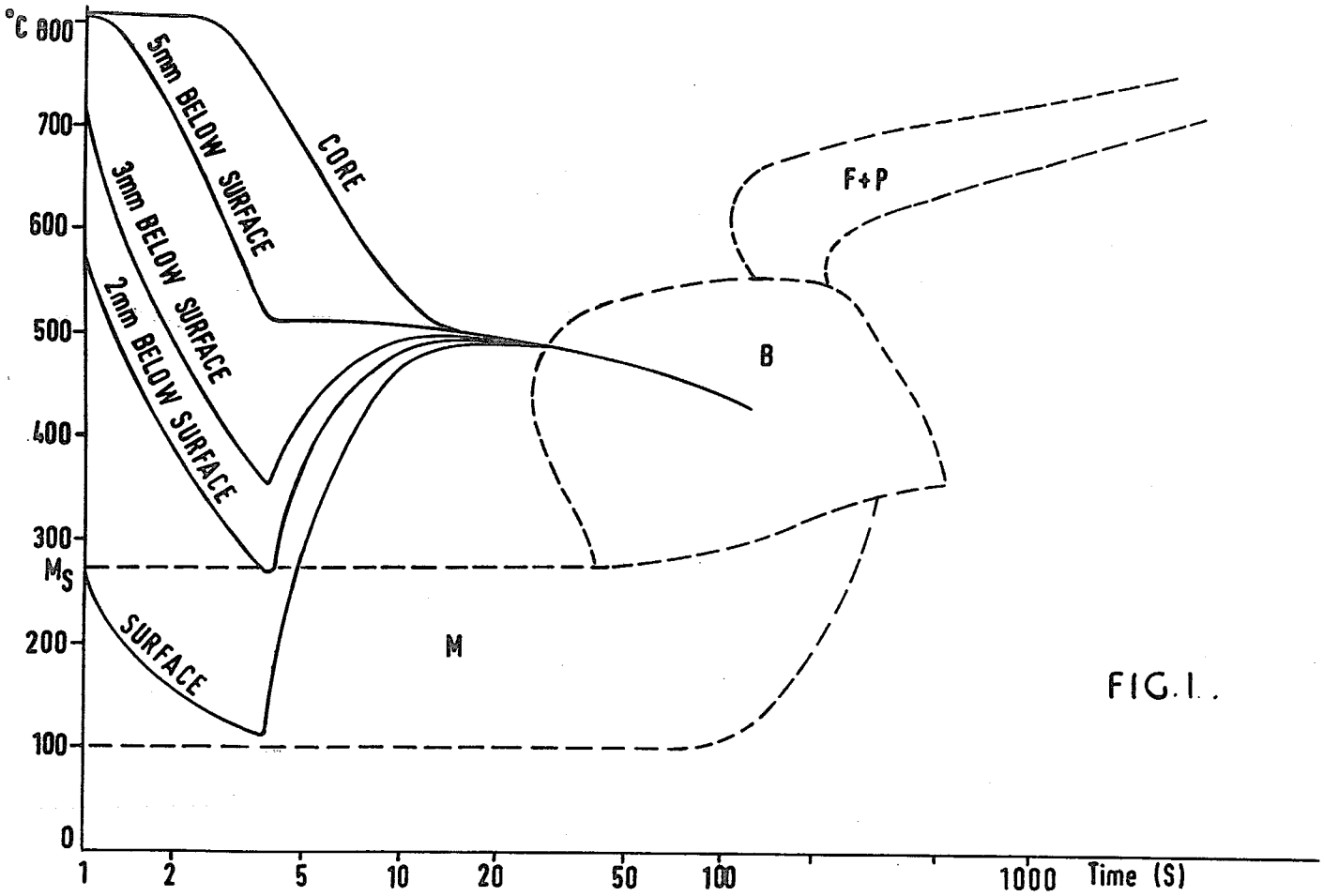
FIG. 1 is CCT diagram, being a graph of temperature versus time.

FIG. 1 shows by way of example the CCT diagram (continues cooling time) corresponding to the above-mentioned second embodiment applied to a tube whose technical characteristics and conditions of treatment are as follows. A non-welded tube 133 mm in external diameter and 10 mm thick is treated. The tube is of steel and contains (by weight) 0.42% C, 0.8% Mn, 0.25% Si, and 1.1% Cr; it is quenched only on its external surface.

This tube was subjected to a quenching treatment for 3.5 seconds starting at an initial temperature of 830° C. The following results were obtained:

percentage of martensite: m=22%
tempering temperature: $T_r$=494° C.
tensile strength: $R_r$=1060 MPa
elastic limit: $R_e$=880 MPa
elongation: A=12%
surface hardness: HV=440 (Vickers 10 kg).

In both these embodiments the cooling means may, depending on the case in question and the dimensions of the tube being cooled, consist of cooling boxes (generally known by the term "canon"), or spray nozzles or batteries of spray nozzles that project water or an aqueous mist, with or without an agent that increases the heat transfer coefficient, or may be any other type of cooling means.

The above two embodiments are thus characterised by superficial martensitic and/or bainitic quenching, followed by tempering of this superficial part and transformation of the residual austenite. The temperature at which this transformation starts is uniquely related, other things being equal, to the amount of martensite and/or bainite in the surface, any variation in this amount, m, causing a corresponding variation in the resulting equalisation temperature (or tempering temperature), and consequently in the starting temperature of the transformation.

It is useful to recall here that, according to a known process, a superficial martensitic and/or bainitic layer may be obtained at the end of a quenching phase. The temperature equalisation of the section envisaged in this known process enables a tempering temperature, $T_r$, to be obtained whose value depends, for specific dimensions of the section and a given cooling arrangement, on the percentage m of martensite present in the section at the end of the quenching phase. These two values, $T_r$ and m, cannot vary independently for a section of given shape and for a given cooling arrangement; rather, the properties and morphology of the products of the transformation of the residual austenite depends on the value of $T_r$. It is to this process that the afore-mentioned two embodiments relate, which are nevertheless two specific instances of an application to tubular sections.

According to a variant of the afore-mentioned embodiments, which can also be applied to tubes, it is possible to vary, between certain limits, the starting temperature of the transformation independently of the amounts of martensite and/or bainite obtained during the superficial quenching.

This variant provides a great degree of flexibility in the process and enables the two factors m and $T_r$ to be varied independently, which is of particular interest for example in the case of low alloy steels. By virtue of the process of this variant, a certain percentage of very ductile tempered martensite (high $T_r$) may be obtained in the surface, while producing lower bainite in the core having a good ductility—toughness—strength combination.

This process constituting the subject of the said variation is basically characterised in that tubes are subjected, at least on one of their surfaces, to a quenching and hardening treatment comprising the following four phases and in the stated order, the said treatment being applied to tubes at a temperature corresponding to the austenitic state which may possibly contain at most 15% of ferrite, and irrespective of the processes to which the metal of the tube has been subjected in this state (outlet of a hot rolling mill, heat treatment, etc.).

1. Superficial quenching of at least one surface (internal or external) of the tube in the martensitic range (that is to say to a temperature below $M_s$), the remainder of the tube remaining in the austenitic state.

2. Self-tempering of the martensitic layer by the reheating of the superficial zone by virtue of the thermal energy remaining available in the non-quenched part of the tube; this self-tempering may be stopped at a skin temperature lower than the tempering temperature, that is to say at the temperature at which the superficial part and centre part of the tube would converge if the following step were not carried out.

3. Sudden and intense cooling of the tube, controlled in such a way that the points of the tube cross-section reaching a temperature lower than $M_s$ during this step are at most those that have already been cooled below this temperature during the initial quenching (in other words, the volume percent of martensite remains at that value obtained during the first step).

4. After this sudden and intense cooling step, a new self-tempering of the cooled zone is allowed to take place, resulting in temperature equalisation throughout the cross-section of the tube and in the transformation of the remaining austenite starting from the equalisation temperature thus reached ($T_e$); where appropriate, this temperature equalisation and final transformation of the residual austenite may be preceded by a second or even a third cooling and self-tempering phase, such as carried out in steps 3 and 4.

It has been found that the structure and properties of the steel in the core of the product now depend no longer on $T_r$, but on $T_e$. They thus vary with $T_e$, which depends on the temperature at which the second cooling started and the duration of the said second cooling. It is thus possible to vary the temperature of the start of the transformation of the residual austenite independently of the amount of martensite, m.

It should be emphasised here that the best results that can be obtained by means of the process of this variant are due only to the fact that the equalisation temperature $T_e$ is obtained or practically obtained before the start of the transformation of the residual austenite into bainite. Such a property is represented graphically on a CCT (continuous cooling time) diagram by the fact that the product representing the second equalisation phase is reached before the austenite-bainite transformation curve of the core region of the steel.

The multi-phase quenching process may be applied either to a steel product as it leaves the hot-rolling mill, or to a product reheated to a suitable temperature. This temperature may correspond either to the pure austenitic state of the steel in question, or to a mixed austenitic state containing at most 15% of ferrite, before the application of the first quenching step of the said process. In the latter case it is preferred to employ electrical induction heating for reasons of uniformity of temperature and ease of regulation.

According to an advantageous aspect of this latter variant, after the second self-tempering phase or the last of these phases, the tube is subjected to additional annealing by the external application of energy, in this case also preferably by means of electric induction heating. This procedure has the particular advantage of enabling the degree of tempering of the martensite to be increased, all other factors remaining constant. The flexibility of the process is thus further enhanced.

It may be noted here that French Pat. No. 74.19251 discloses a process according to which a steel bar is subjected, at the outlet of a hot-rolling mill, to one or a plurality of extremely intense cooling steps using water, so that an enclosed region having an extremely fine martensitic microstructure is formed in the superficial zone of the bar for a minimum thickness of 0.2 mm over its circumference immediately after the water cooling operation, and the said extremely fine martensitic microstructure may be cooled sufficiently during a subsequent cooling phase in still air so that there takes place a natural equalisation of the temperature throughout the whole bar as a result of the dispersion of heat occurring under such conditions from the core of the bar up to its superficial region.

Compared with French Pat. No. 74,19251, the process of the invention as disclosed in its last variant has the following basic differences:

The sole objective of the multi-step quenching disclosed in the French Patent is to form a martensitic layer of the desired thickness. While these steps take place the austenite contained in the central part of the bar may start to undergo transformation, as shown in FIG. 2 of the said patent.

In the case of the above-described process according to the present invention, on the other hand, the core zone exists in the metastable austenite state throughout the four steps of the process. According to one of the possibilities, the object of the second and third steps is to bring the austenite contained in the central region into a region of the CCT diagram such that it undergoes transformation into bainite.

Figure 2:
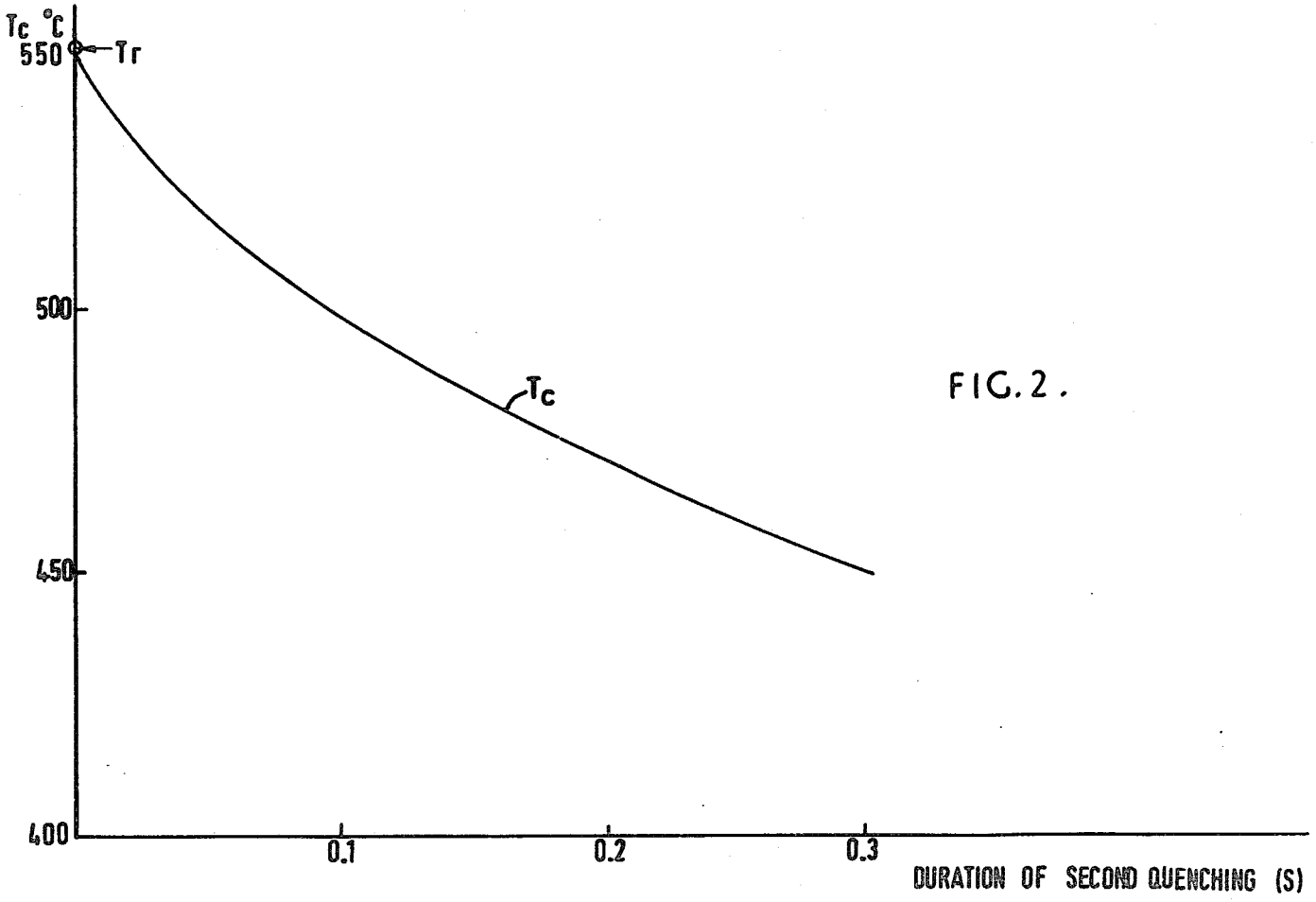
FIG. 2 is a graph of temperature versus quenching time.

FIG. 2 shows how the value of the equalisation temperature $T_e$ may be varied within a large range independently of the theoretical tempering temperature $T_r$, for a tube 914 mm in external diameter, 12.5 mm thick, and at an initial temperature of 900° C.

Figure 3:
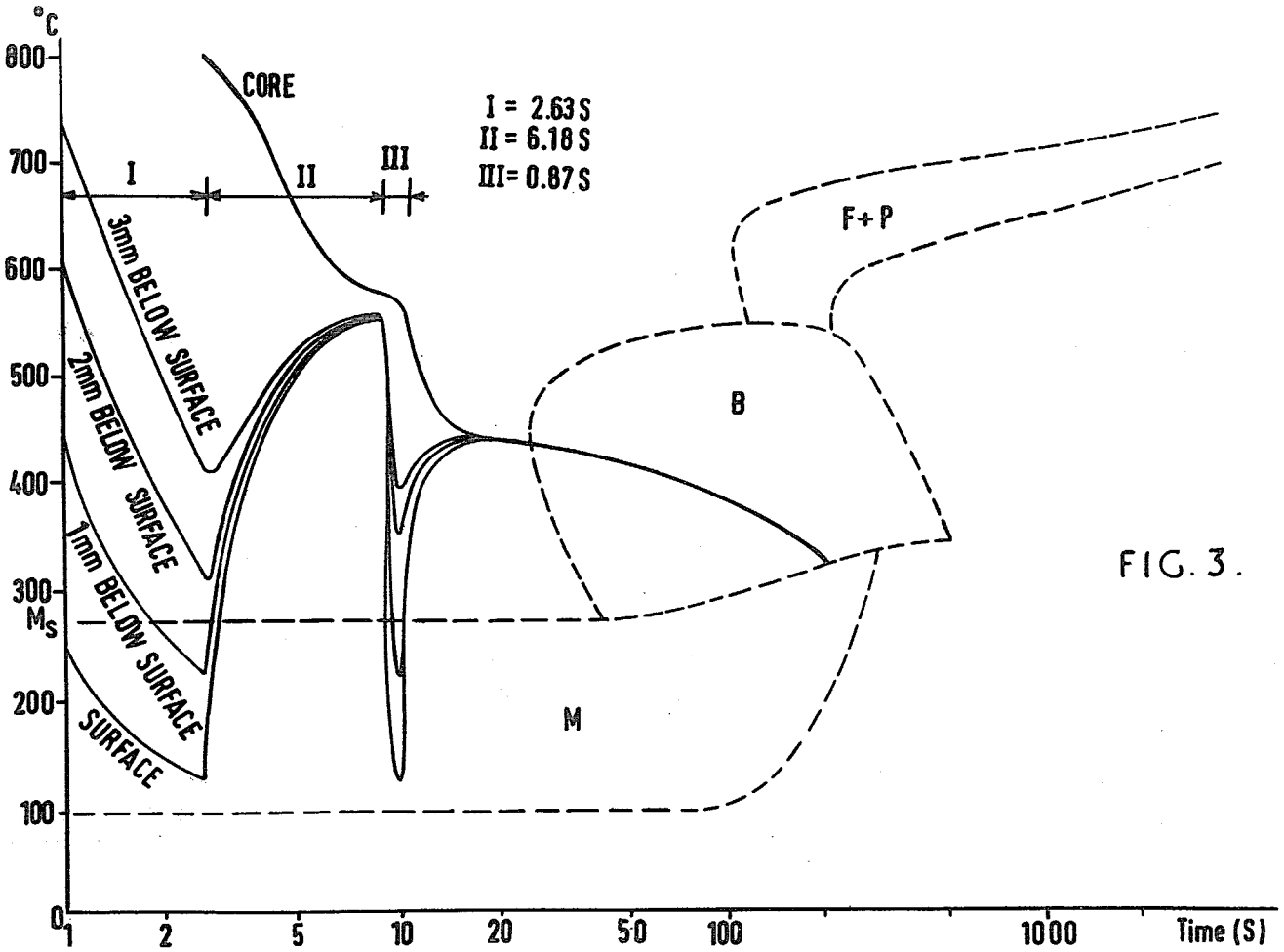
FIG. 3 is another CCT diagram.

FIG. 3 shows how the procedure of the last variant of the invention, applied to a tube having the same characteristics as that mentioned above, has enabled the said characteristics to be improved. The results of this treatment are given below.

first quenching: 2.63 s, from 830° C.;
first tempering: 6.18 s;
second cooling: 0.88 s.
the following results were obtained:
percentage of martensite: m=5%
tempering temperature: $T_r$=567° C.
temperature of transformation of the core: $T_c$=446° C.
tensile strength: $R_r$=1072 MPa
elastic limit: $R_e$=882 MPa
elongation: A=13.1%
surface hardness: HV=390 (Vickers 10 kg).

It is thus found that the elongation has been increased while maintaining the tensile strength at the desired value. The skin hardness has decreased owing to the increase in $T_r$ (corresponding decrease in m).

A steel tube 914 mm in diameter and 12.5 mm thick and containing (by weight) 0.12% C, 1.1% Mn, 0.2% Si, 0.04% Al, and 0.12% V, was subjected to a process of the invention, the details of the procedure being as follows:

first quenching: 1.36 s;
tempering for 5s, to 680° C.;
second cooling for 0.44 s;
second tempering at the starting temperature (590° C.) of the transformation of the core region.

The following results was obtained:
percentage of martensite, m: 11%
tensile strength, $R_r$: 810 MPa
elastic limit, $R_e$: 690 MPa
elongation, A: 25%
toughness, −60° C.: 100 Nm/cm$^2$.

I claim:

1. A process for treating a tubular steel section by the sequential steps of providing the section at a temperature greater than a temperature between $Ac_3$ and $Ac_1$, corresponding to at most 15% ferrite in the steel, comprising:

(a) subjecting the section to quenching producing martensite, by intense cooling by means of a cooling agent to a temperature below $M_s$, and subjecting the section to still air cooling, in which the conditions of intense cooling are such that the effects of quenching are limited to at least one surface layer of the section and that, at the end of the quenching step, that part of the section remote from the quenched surface layer is at a temperature above 675° C. which permits self-tempering of the quenched surface layer at a temperature above 450° C. and ensures transformation of residual austenite to a martensite-free structure;

(b) terminating the self-tempering of the superficial martensite at a skin temperature lower than the theoretical equalisation temperature or tempering temperature, the said theoretical temperature being the temperature to which the surface and the central part of the tube would converge if the following step (c) were not applied;

(c) following step (b), subjecting the section to sudden and intense cooling such that the points of the section reaching a temperature lower than $M_s$ during this cooling are at most those that have already been cooled below this temperature during the initial quenching step; and (d) after this cooling step (c), allowing renewed self-tempering of the cooled zone to take place, resulting in temperature equalisation throughout the section and then in the transformation of the residual austenite starting from the equalisation temperature thus reached.

2. A process as claimed in claim 1, in which the intensity and duration of quenching in step (a) are such that, after equalisation of the temperatures in the section during self-tempering, transformation of the residual austenite into ferrite+carbides takes place.

3. A process as claimed in claim 2, in which the duration of the quenching step (a) is between 5 and 15 seconds.

4. A process as claimed in claim 1, in which the tube wall thickness is greater than 6 mm.

5. A process as claimed in claim 1, in which the steel has the following composition by weight:

| |
|---|
| 0.10% ≦ C ≦ 0.15% |
| 1% ≦ Mn ≦ 1.5% |
| 0.2% ≦ Si ≦ 0.4% |
| Cu ≦ 0.2% |
| 0.5% ≦ Ni ≦ 1% |
| Cr ≦ 0.8% |
| 0.1% ≦ Mo ≦ 0.4% |

the remainder being iron and its usual impurities.

6. A process as claimed in claim 1, in which the quenching is in the martensite range, the intensity and duration of quenching being such that, after equalisation of the temperatures in the section during self-annealing, the residual austenite is substantially transformed into bainite.

7. A process as claimed in claim 6, in which the residual austenite is substantially transformed into lower bainite.

8. A process as claimed in claim 1, in which the cooling step (b) is carried out with an intensity and for a period of time such that, after the said equalisation of the temperatures, the residual austenite undergoes transformation into ferrite+carbides.

9. A process as claimed in claim 1, in which the cooling (b) is carried out with an intensity and for a period of time such that, after the said equalisation of the temperatures, the residual austenite undergoes transformation into bainite.

10. A process as claimed in claim 9, in which the residual austenite undergoes transformation into lower bainite.

11. A process as claimed in claim 1, in which the equalisation temperature and the final transformation of the residual austenite are preceded by at least one further cooling and self-tempering phase in accordance with steps (b) and (c).

12. A process as claimed in claim 1, in which, after the last self-tempering step, additional tempering is carried out by supplying heat by external means.

13. A process as claimed in claim 12, in which the heat is supplied by means of electrical induction.

14. A process as claimed in claim 1, in which the initial temperature of the section is obtained by heating the tube by electrical induction.

* * * * *